US009829007B2

(12) United States Patent
Klingler

(10) Patent No.: US 9,829,007 B2
(45) Date of Patent: Nov. 28, 2017

(54) TURBINE SEALING SYSTEM

(71) Applicant: General Electric Company, Schenectady, NY (US)

(72) Inventor: Brett Darrick Klingler, Greenville, SC (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 860 days.

(21) Appl. No.: 14/286,064

(22) Filed: May 23, 2014

(65) Prior Publication Data

US 2015/0337852 A1 Nov. 26, 2015

(51) Int. Cl.

| | |
|---|---|
| ***F04D 29/10*** | (2006.01) |
| ***F01D 11/12*** | (2006.01) |
| ***F01D 11/16*** | (2006.01) |

(52) U.S. Cl.

CPC ..... *F04D 29/10* (2013.01); *F01D 11/16* (2013.01); *F01D 11/12* (2013.01)

(58) Field of Classification Search

CPC ..... F01D 11/12; F01D 11/16; F01D 11/025; F04D 29/10; F16J 15/162

USPC ..... 415/173.3; 277/413

See application file for complete search history.

(56) References Cited

U.S. PATENT DOCUMENTS

| | | | | |
|---|---|---|---|---|
| 3,971,563 | A * | 7/1976 | Sugimura | F16J 15/162 277/413 |
| 5,603,510 | A * | 2/1997 | Sanders | F01D 11/025 277/413 |
| 6,659,472 | B2 | 12/2003 | Aksit et al. | |
| 7,040,857 | B2 | 5/2006 | Chiu et al. | |
| 8,021,103 | B2 | 9/2011 | Willett, Jr. | |
| 8,262,349 | B2 * | 9/2012 | Turnquist | F01D 11/025 277/412 |
| 8,608,424 | B2 | 12/2013 | Jain et al. | |

* cited by examiner

*Primary Examiner* — Mark Laurenzi
*Assistant Examiner* — Paul Thiede
(74) *Attorney, Agent, or Firm* — Dority & Manning, PA

(57) ABSTRACT

A system for reducing leakage between static and rotating components within a turbine includes a static structure that is disposed radially outward from a tip of a rotating component. The static structure includes a seal assembly slot formed therein. A seal assembly includes a support block that is disposed within the seal assembly slot. A sealing material is disposed along a bottom portion of the support block and a tip slot is formed within the sealing material. The support block includes a forward portion that is slideably engaged with a forward inner surface of the seal assembly slot and an aft portion that is slideably engaged with an aft inner surface of the seal assembly slot. The system further includes a spring that extends axially between an aft wall of the seal assembly slot and an aft wall of the support block.

19 Claims, 3 Drawing Sheets

TURBINE SEALING SYSTEM

FIELD OF THE INVENTION

The present invention generally involves a turbomachine. More specifically, the invention relates to a turbine sealing system which reduces flow leakage between static and rotating components of the turbine portion of the turbomachine.

BACKGROUND OF THE INVENTION

A turbomachine such as a steam turbine or a gas turbine generally includes a rotatable shaft that extends axially within an outer casing. Multiple rows of stationary vanes or nozzles extend radially inwardly from the outer casing. Adjacent rows of stationary vanes are axially separated by a row of rotor blades. The rotor blades are coupled to the shaft and extend radially outwardly therefrom towards the outer casing.

A shroud or seal assembly extends from an inner surface of the outer casing towards a radially outer tip of each rotor blade. In particular turbomachines, the seal assembly is rigidly fixed in position. An outer radial gap is defined between the tips of the rotor blades and a sealing material is disposed along a radially inner portion of the seal assembly. Generally, the outer radial gap is sufficiently sized to allow for thermal growth of the rotor blades as the turbomachine transitions between various operating modes and/or to reduce the potential for a tip strike against the seal assembly while reducing fluid flow through the outer radial gap.

Rotor seals may be attached to the rotor shaft and may extend radially outward therefrom towards a bottom portion of the stationary vanes. A seal assembly including a sealing material is disposed along the bottom portion of the stationary vanes. An inner radial gap is defined between the rotor seals and the bottom portion of the stationary vanes. Generally, the inner radial gap is sufficiently sized to allow for thermal growth of the rotor shaft and/or the stationary vanes as the turbomachine transitions between various thermal transitions while reducing fluid flow through the inner radial gap.

In operation, a working fluid such as combustion gases or pressurized steam is routed onto a pressure side of each rotor blade. Kinetic and/or thermal energy from the working fluid is transferred to the rotor blades which causes the shaft to rotate. Typically, a portion of the working fluid may leak through the outer radial gap, thereby potentially reducing overall turbine efficiency. In addition, a second working fluid such as a cooling media may be routed through and/or around the stationary vanes to provide cooling thereto. In order to efficiently cool the various components, leakage of the second working fluid between the tip of the rotor seal and the sealing material should be minimized. Therefore, an improved system for reducing flow leakage between static and rotating components of a turbine would be useful in the turbomachine industry.

BRIEF DESCRIPTION OF THE INVENTION

Aspects and advantages of the invention are set forth below in the following description, or may be obvious from the description, or may be learned through practice of the invention.

One embodiment of the present invention is a turbine sealing system. The system includes a static structure that is disposed radially outwardly from a tip of a rotating component of the turbine. The static structure includes a seal assembly slot that is formed therein. The system further includes a seal assembly having a support block that is disposed within the seal assembly slot. A sealing material is disposed along a bottom portion of the support block and a tip slot is formed within the sealing material. The support block includes a forward portion that is slideably engaged with a forward inner surface of the seal assembly slot and an aft portion that is slideably engaged with an aft inner surface of the seal assembly slot. The system also includes a spring that extends substantially axially between an aft wall of the seal assembly slot and an aft wall of the support block.

Another embodiment of the present invention is a turbine. The turbine includes a rotor shaft and a static structure that is at least partially defined by an outer casing that circumferentially surrounds the rotor shaft. The outer casing at least partially defines a seal assembly slot that is formed along an inner surface of the outer casing. A plurality of rotating components is defined by a plurality rotor blades interconnected to the rotor shaft and that extend radially outwardly therefrom towards the inner surface of the outer casing. Each rotor blade includes a radially outer tip. The turbine further includes a seal assembly having a support block that is disposed or installed within the seal assembly slot. A sealing material is disposed along a bottom portion of the support block and a tip slot is formed within the sealing material. The sealing material extends radially inwardly towards the tips of the rotor blades. The support block includes a forward portion that is slideably engaged with a forward inner surface of the seal assembly slot and an aft portion that is slideably engaged with an aft inner surface of the seal assembly slot. The turbine also includes a spring that extends axially between an aft wall of the seal assembly slot and an aft wall of the support block.

The present invention may also include a turbine. The turbine includes a rotor shaft, a rotating component defined by a rotor seal that extends radially outwardly from the rotor shaft, an outer casing that circumferentially surrounds the rotor shaft and a static structure at least partially defined by a plurality of stationary vanes that extend radially inwardly from the inner casing towards the rotor seal where each stationary vane at least partially defines a seal assembly slot formed along a bottom portion of the stationary vanes. The turbine further includes a seal assembly having a support block that is disposed within the seal assembly slot. A sealing material is disposed along a bottom portion of the support block and a tip slot is formed within the sealing material. The sealing material extends radially inwardly towards a tip of the rotor seal. The support block includes a forward portion that is slideably engaged with a forward inner surface of the seal assembly slot and an aft portion that is slideably engaged with an aft inner surface of the seal assembly slot. The turbine also includes a spring that extends substantially axially between an aft wall of the seal assembly slot and an aft wall of the support block.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
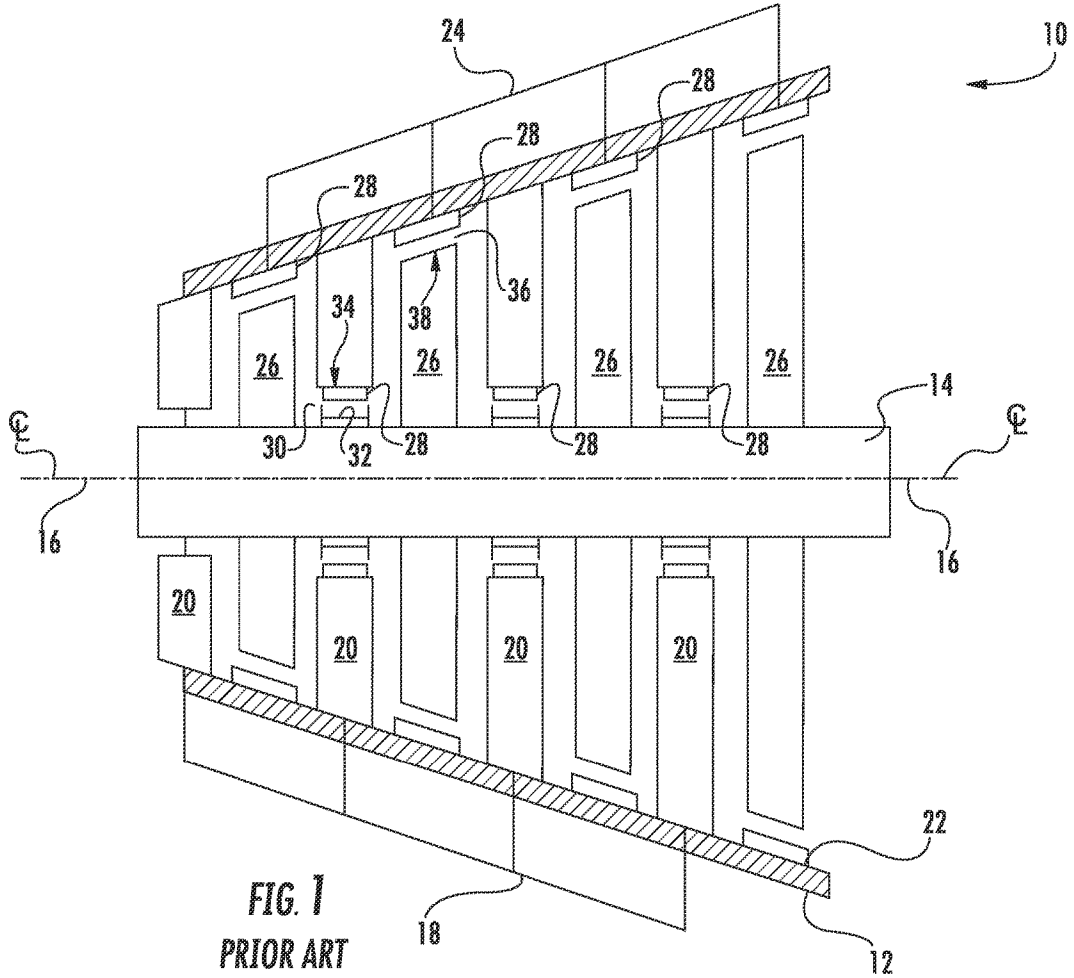
FIG. 1 PRIOR ART
FIG. 1 is a side view of an exemplary turbine as may incorporate various embodiments of the present invention.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention. As used herein, the terms "first", "second", and "third" may be used interchangeably to distinguish one component from another and are not intended to signify location or importance of the individual components. The terms "upstream" and "downstream" refer to the relative direction with respect to fluid flow in a fluid pathway. For example, "upstream" refers to the direction from which the fluid flows, and "downstream" refers to the direction to which the fluid flows. The term "radially" refers to the relative direction that is substantially perpendicular to an axial centerline of a particular component, and the term "axially" refers to the relative direction that is substantially parallel to an axial centerline of a particular component.

Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents. Although exemplary embodiments of the present invention will be described generally in the context of an industrial gas turbine turbomachine for purposes of illustration, one of ordinary skill in the art will readily appreciate that embodiments of the present invention may be applied to any turbomachine such as a steam turbine and is not limited to an industrial gas turbine unless specifically recited in the claims.

Referring now to the drawings, FIG. 1 provides a side view of an exemplary turbine 10 as may incorporate various embodiments of the present invention, with a portion of an outer casing 12 of the turbine 10 cut away for clarity. The turbine 10 as shown in FIG. 1, may represent a portion of a steam turbine or a high pressure or low pressure gas turbine. As shown, the turbine 10 generally includes a rotor shaft 14 that extends axially through the turbine 10 with respect to an axial centerline 16 of turbine 10. The outer casing 12 circumferentially surrounds the rotor shaft 14.

Multiple rows 18 of stationary vanes 20 or nozzles extend radially inwardly from an inner surface 22 of the outer casing 12 towards the rotor shaft 14. Adjacent rows 18 of the stationary vanes 20 are axially separated by rows 24 of rotor blades 26. Although a particular number of rows 18, 24 of the stationary vanes 20 and rotor blades 26 are shown in FIG. 1, the turbine 10 may comprise any number of rows of stationary vanes 20 and rotor blades 26. The rotor blades 26 are coupled or interconnected to the rotor shaft 14 and extend radially outwardly therefrom towards the inner surface 22 of the outer casing 12.

In particular embodiments, seal assemblies 28 are used to seal various radial gaps defined within the turbine 10. For example, an inner radial gap 30 is defined between a rotor shaft seal 32 and bottom portions 34 of each of the stationary vanes 20. An outer radial gap 36 is defined between a tip portion 38 of each rotor blade 26 and the inner surface 22 of the outer casing 12. In particular embodiments, seal assemblies 28 are disposed between the rotor shaft seal 32 and the bottom portions 34 of each of the stationary vanes 20 to reduce or control the inner radial gap 30 during operation of the turbine 10. In addition or in the alternative, seal assemblies 28 are disposed between the tip portion 38 of each rotor blade 26 and the inner surface 22 of the outer casing 12 to reduce or control the outer radial gap 36 during operation of the turbine 10.

In operation, a highly pressurized working fluid such as hot combustion gases or steam is routed into the turbine 10. The stationary vanes 20 direct the working fluid onto a pressure side (not shown) of each of the rotor blades 26. Kinetic and/or thermal energy from the working fluid is transferred to the rotor blades 26 which cause the rotor shaft 14 to rotate. Typically, a portion of the working fluid leaks through the outer radial gaps 36 which reduces the amount of kinetic energy available for transfer to the rotor blades 26, thus potentially reducing overall turbine efficiency. In some embodiments, the working fluid is a cooling media such as compressed air and/or steam that is routed through various cooling circuits defined within the turbine 10, particularly through and/or around the stationary vanes 20. As a result, at least a portion of the working fluid may leak through the inner radial gaps 30, thus potentially reducing the overall efficiency of the turbine 10.

Figure 2:
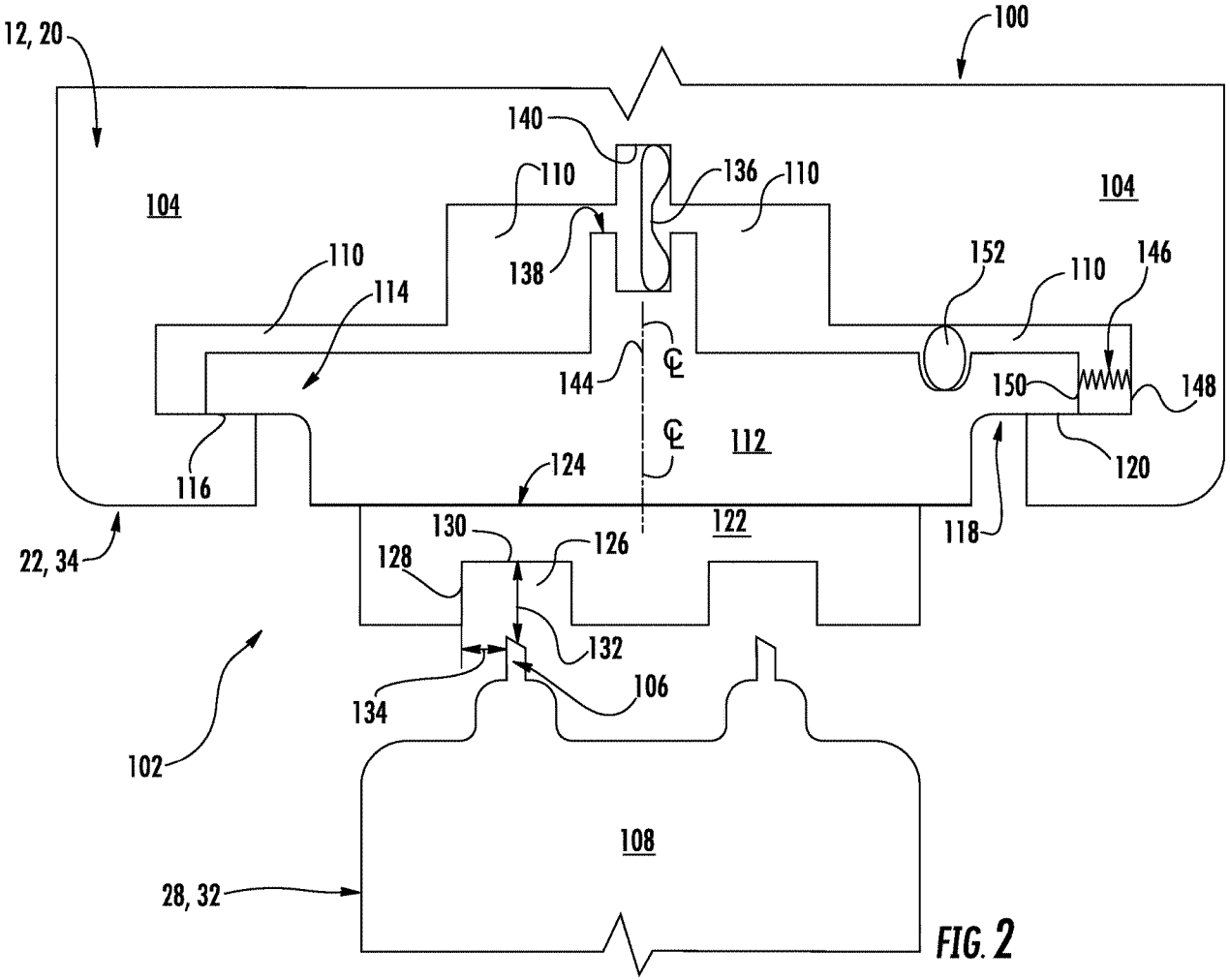
FIG. 2 is a turbine sealing system according to various embodiments of the present invention.

FIG. 2 illustrates a turbine sealing system 100 herein referred to as "system", according to various embodiments of the present invention. The system 100 generally reduces or controls leakage between static components and rotating components within the turbine 10. In one embodiment, the system 100 includes a seal assembly 102 which is seated within a static structure 104 of the turbine 10 (FIG. 1). The seal assembly 102 is disposed radially outwardly from a tip portion 106 of a rotating component 108 of the turbine 10. The seal assembly 102 of the present invention may be configured or modified to be used in place of any of the seal assemblies 28 as shown FIG. 1. In one embodiment, the rotating component 108 is a rotor blade 26 (FIG. 1) or plurality of rotor blades and the static structure 104 is at least partially defined by the outer casing 12 (FIG. 1). The tip portion 106 is defined by a tip portion of the rotor blade 26. In another embodiment, the rotating component 108 is the rotor shaft seal 32 (FIG. 1) and the static structure 104 is a stationary vane 20 (FIG. 1) or a plurality of stationary vanes 20 arranged circumferentially within the turbine 10. The tip portion 106 is defined by a tip portion of the rotor seal 32. In either embodiment, the system 100 as described herein functions in substantially similar or the same manner.

A seal assembly slot 110 or groove is formed within the static structure 104. The seal assembly slot 110 is shaped to receive a support block 112 of the seal assembly 102. When in situ, a forward portion 114 or arm of the support block 112 is slideably engaged with a forward inner surface 116 of the seal assembly slot 110. An aft portion 118 of the support block 112 is slideably engaged with an aft inner surface 120 of the seal assembly slot 110, thus allowing for axial movement of the seal assembly 102 within the seal assembly slot 110 with respect to the axial centerline 16 (FIG. 1) of the turbine 10.

In one embodiment, as shown in FIG. 2, a sealing material 122 is connected to a bottom portion 124 of the support block 112. The sealing material 122 extends substantially radially towards the tip portion 106 of the rotating component 108. The sealing material 122 may include a honeycomb shaped or other shaped abradable material. In particular embodiments, a tip slot or groove 126 is formed within the sealing material 122. In one embodiment, the tip slot 126 includes a wall portion 128 and a floor portion 130. The wall portion 128 extends substantially radially outwardly from the floor portion 130, for example, radially towards and/or beyond the tip portion 106 when the sealing assembly 102 is installed into the turbine 10.

The floor portion 130 extends generally axially aft from the wall portion 128. The tip slot 126 is generally sized and/or positioned to define a radial gap 132 between the floor portion 130 of the sealing material 122 and the tip portion 106 of the rotating component 108. In addition, the tip slot 126 is sized and/or positioned so as to define an axial gap 134 between the wall portion 128 and the tip portion 106.

In one embodiment, a seal or gasket 136 extends radially between a top portion 138 of the support block 112 and a top or upper inner surface 140 of the seal assembly slot 110. The seal 136 may be seated within complementary grooves or notches formed in the top portion 138 of the support block 112 and/or the top inner surface 140 of the seal assembly slot 110. In one embodiment, the seal 136 is seated proximate to a radial centerline 144 of the support block 112. The seal 136 may be of any suitable shape such but not limited to dog-bone or "v" shaped.

In various embodiments, a spring 146 is disposed between the static structure 104 and the support block 112. In one embodiment, the spring 146 is disposed between an aft wall 148 of the seal assembly slot 110 and an aft wall 150 of the support block 112. The spring 146 may comprise any suitable spring type such as but not limited to a coil spring (as shown in FIG. 2), a leaf spring, a "v" spring, a cantilevered spring or a wave spring. In one embodiment, a bearing 152 is disposed within the seal assembly slot 110 between the support block 112 and the static structure 104. The bearing 152 may comprise a roller bearing, a journal bearing or any suitable bearing so as to allow relative axial movement between the static structure 104 and the support block 112 during operation of the turbine 10.

Figure 3:
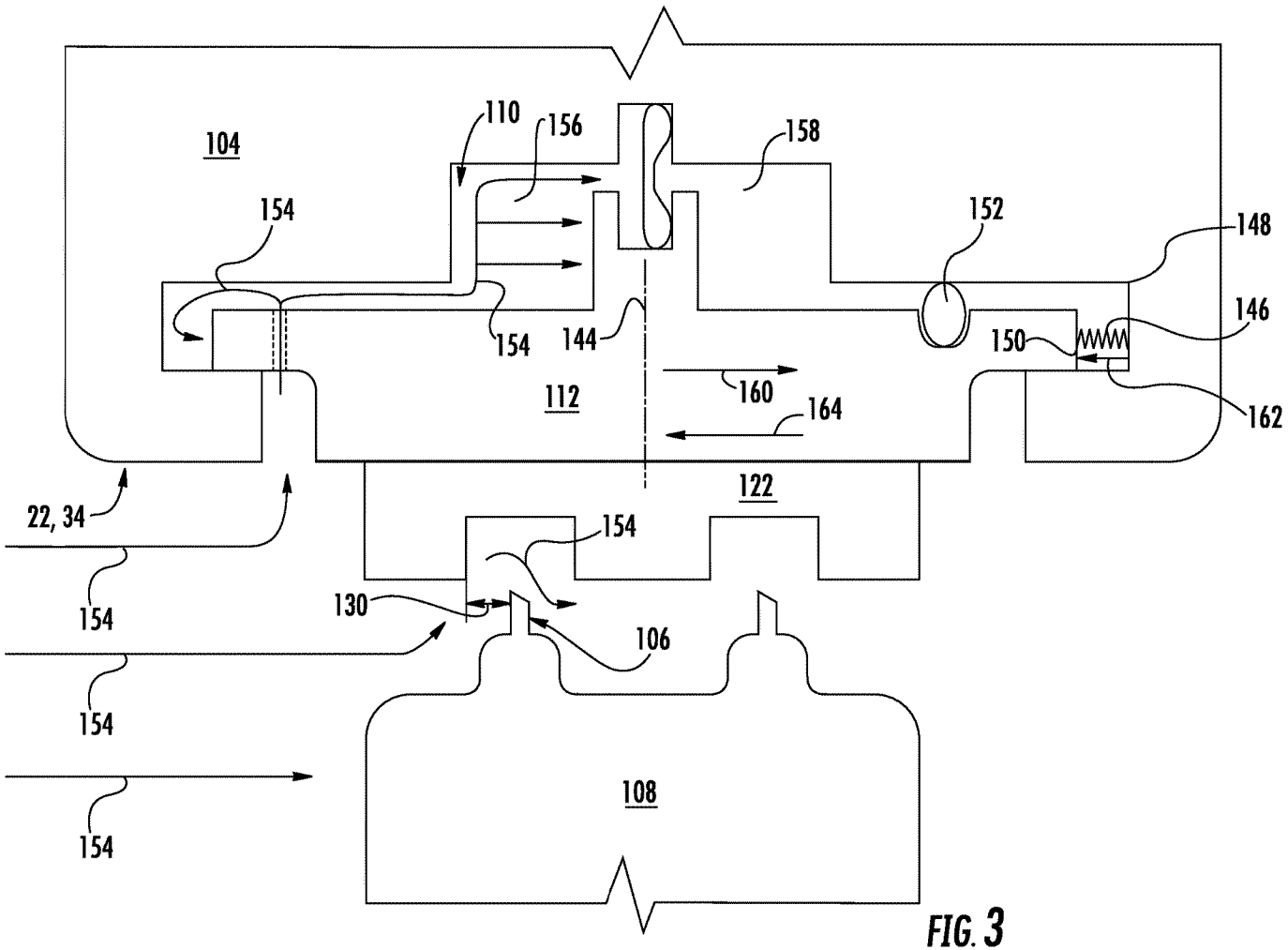
FIG. 3 is a side view of the turbine sealing system as shown in FIG. 2 in operation, according to various embodiments of the present invention.

FIG. 3 is an operational side view of the system 100 as shown in FIG. 2, according to various embodiments of the present invention. In operation, as shown in FIG. 3, a working fluid 154 such as combustion gases, steam or compressed air is routed towards the rotating component 108. A portion of the working fluid 154 flows into the seal assembly slot 110 between the support block 112 and the static structure 104. The seal 136 prevents or restricts the flow of the working fluid 154 within the seal assembly slot 110 towards the aft wall 148, thus forming a high pressure area 156 and a lower pressure area 158 defined within the seal assembly slot 110. The higher pressure area 156 being formed forward or upstream from the seal 136 and the lower pressure area 158 being formed aft or downstream from the seal 136.

As pressure of the working fluid 154 within the high pressure area 156 increases, for instance due to an increase in turbine speed and/or load, a pressure differential between the high and lower pressure areas 156, 158 increases as well. Once the pressure differential reaches a predefined limit that is sufficient to compress the spring 146, the support block 112 moves or translates in a positive axial direction 160, towards an aft end of the turbine 10. As a result, the axial gap 134 is decreased, thus resulting in reduced leakage of the working fluid 154 over the tip portion 106 of the rotating component 108, thereby increasing overall turbine efficiency. As the pressure differential decreases, the spring 146 will exert a counter or negative axial force 162 to the support block 112, thus moving the support block 112 in a negative axial direction 164 which is opposite the positive axial direction 160, thereby biasing the support block 112 towards a starting position within the seal assembly slot 110, thereby increasing the axial gap 134 and allowing for greater clearance between the sealing material 122 and the tip portion 106.

In particular embodiments, the bearing 152 may reduce friction between the static structure 104 and the seal assembly slot 110. In addition, the bearing 152 may prevent the seal assembly 102, particularly the support block 112 from cantilevering radially upwardly within the seal assembly slot 110 during operation of the turbine 10.

The system 100 as described herein and as illustrated in FIGS. 2 and 3, provides technical benefits over existing sealing technologies. For example, by reducing the axial gap 134 between the tip portion 106 and the sealing material 122, a greater portion of the working fluid 154 may be utilized for its intended purpose such as providing kinetic energy to the rotating components 108 (i.e. rotor blades) or cooling various portions of the turbine 10, thus improving overall turbine performance.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other and examples are intended to be within the scope of the claims if they include structural elements that do not differ from the literal language of the claims, or if they include equivalent structural elements with insubstantial differences from the literal language of the claims.

What is claimed is:

1. A turbine sealing system, comprising:

a static structure disposed radially outward from a tip of a rotating component, the static structure having a seal assembly slot formed therein;

a seal assembly including a support block disposed within the seal assembly slot, a sealing material disposed along a bottom portion of the support block and a tip slot formed within the sealing material, the support block having a forward portion slideably engaged with a forward inner surface of the static structure and an aft portion slideably engaged with an aft inner surface of the static structure, the tip slot including a wall portion and a floor portion, wherein an axial gap is defined between the wall portion and the tip of the rotating component; and a spring extending axially between an aft wall of the static structure and an aft wall of the support block, wherein compression of the spring reduces the axial gap.

2. The turbine sealing system as in claim 1, further comprising a bearing disposed between a top portion of the support block and a top inner surface of the static structure.

3. The turbine sealing system as in claim 1, wherein a radial gap is defined between the tip of the rotating component and the floor portion.

4. The turbine sealing system as in claim 1, further comprising a seal that extends substantially radially between a top portion of the support block and a top inner surface of the static structure.

5. The turbine sealing system as in claim 4, wherein the seal defines a high pressure area and a lower pressure area within the seal assembly slot.

6. The turbine sealing system as in claim 5, wherein the support block moves in a positive axial direction within the seal assembly slot when a pressure differential between the high pressure area and the lower pressure area exceeds a predefined limit, thereby causing the spring to compress.

7. The turbine sealing system as in claim 1, wherein the rotating component is a rotor blade and the static structure includes an outer casing of the turbine.

8. The turbine sealing system as in claim 1, wherein the rotating component is a rotor seal and the static structure is a stationary vane.

9. A turbine, comprising:

a rotor shaft;

a static structure at least partially defined by an outer casing that circumferentially surrounds the rotor shaft, the outer casing at least partially defining a seal assembly slot formed along an inner surface of the outer casing;

a plurality of rotating components defined by a plurality of rotor blades interconnected to the rotor shaft and extending radially outwardly therefrom towards the inner surface of the outer casing, each rotor blade having a radially outer tip;

a seal assembly including a support block disposed within the seal assembly slot, a sealing material disposed along a bottom portion of the support block and a tip slot formed within the sealing material, the sealing material extending radially inwardly towards the tips of the rotor blades, the support block having a forward portion slideably engaged with a forward inner surface of the static structure and an aft portion slideably engaged with an aft inner surface of the static structure; and a spring extending between an aft wall of the static structure and an aft wall of the support block.

10. The turbine as in claim 9, further comprising a bearing disposed between a top portion of the support block and a top inner surface of the static structure.

11. The turbine as in claim 9, wherein the tip slot comprises a wall portion and a floor portion, wherein an axial gap is defined between the wall portion and the tips of the rotor blades and a radial gap is defined between the tips of the rotor blades and the floor portion.

12. The turbine as in claim 11, wherein compression of the spring reduces the axial gap.

13. The turbine as in claim 9, further comprising a seal that extends substantially radially between a top portion of the support block and a top inner surface of the of the static structure, wherein the seal defines a high pressure area and a lower pressure area within the seal assembly slot.

14. The turbine as in claim 13, wherein the support block moves in a positive axial direction within the seal assembly slot when a pressure differential between the high pressure area and the lower pressure area exceeds a predefined limit, thereby causing the spring to compress.

15. The turbine as in claim 9, wherein the turbine is one of a gas turbine or a steam turbine.

16. A turbine, comprising:

a rotor shaft;

a rotating component at least partially defined by a rotor seal that extends radially outwardly from the rotor shaft;

an outer casing circumferentially surrounding the rotor shaft;

a static structure at least partially defined by a stationary vane that extends radially inwardly from the inner casing towards the rotor seal, the stationary vane at least partially defining a seal assembly slot formed along a bottom portion of the stationary vane;

a seal assembly including a support block disposed within the seal assembly slot, a sealing material disposed along a bottom portion of the support block and a tip slot formed within the sealing material, the sealing material extending radially inwardly towards a tip of the rotor seal, the support block having a forward portion slideably engaged with a forward inner surface of the static structure and an aft portion slideably engaged with an aft inner surface of the static structure; and a spring extending axially between an aft wall of the static structure and an aft wall of the support block.

17. The turbine as in claim 16, wherein the tip slot comprises a wall portion and a floor portion such that an axial gap is defined between the wall portion and the tip of the rotor seal and a radial gap is defined between the tip and the floor portion, wherein compression of the spring reduces the axial gap.

18. The turbine as in claim 16, further comprising a seal that extends substantially radially between a top portion of the support block and a top inner surface of the static structure, the seal defining a high pressure area and a lower pressure area within the seal assembly slot, wherein the support block moves in a positive axial direction within the seal assembly slot when a pressure differential between the high pressure area and the lower pressure area exceeds a predefined limit and moves in a negative axial direction within the seal assembly slot when the pressure differential between the high pressure area and the lower pressure area is less than a predefined limit.

19. The turbine as in claim 16, wherein the turbine is one of a gas turbine or a steam turbine.

* * * * *